US005559852A

United States Patent [19]

Vetter

[11] Patent Number: 5,559,852

[45] Date of Patent: Sep. 24, 1996

[54] ROTARY-ANODE X-RAY TUBE COMPRISING A SLEEVE BEARING

[75] Inventor: Axel Vetter, Hamburg, Germany

[73] Assignee: U.S. Philips Corporation, New York, N.Y.

[21] Appl. No.: 382,765

[22] Filed: Feb. 2, 1995

[30] Foreign Application Priority Data

Feb. 2, 1994 [DE] Germany ..... 44 03 116.5

[51] Int. Cl.[6] ..... H01J 35/10

[52] U.S. Cl. ..... 378/133; 378/132

[58] Field of Search ..... 378/132, 133

[56] References Cited

U.S. PATENT DOCUMENTS 5,189,688 2/1993 Ono et al. ..... 378/133

FOREIGN PATENT DOCUMENTS 0479198 4/1992 European Pat. Off. .

0552808 7/1993 European Pat. Off. .

*Primary Examiner*—Craig E. Church

*Attorney, Agent, or Firm*—Jack D. Slobod

[57] ABSTRACT

A rotary-anode X-ray tube, having a sleeve beating with a stationary bearing portion and a rotatable bearing portion, one of the facing surfaces of which is provided with a groove pattern, in which a bearing gap formed between the two bearing portions is filled with a lubricant at least at the area of the groove pattern. Gas inclusions can be discharged from the area of the bearing in that in at least one of the two bearing portions, in an area outside the groove pattern, there is provided a filter member which cannot be wetted by the lubricant and via which the bearing gap communicates with the vacuum space of the X-ray tube.

11 Claims, 1 Drawing Sheet

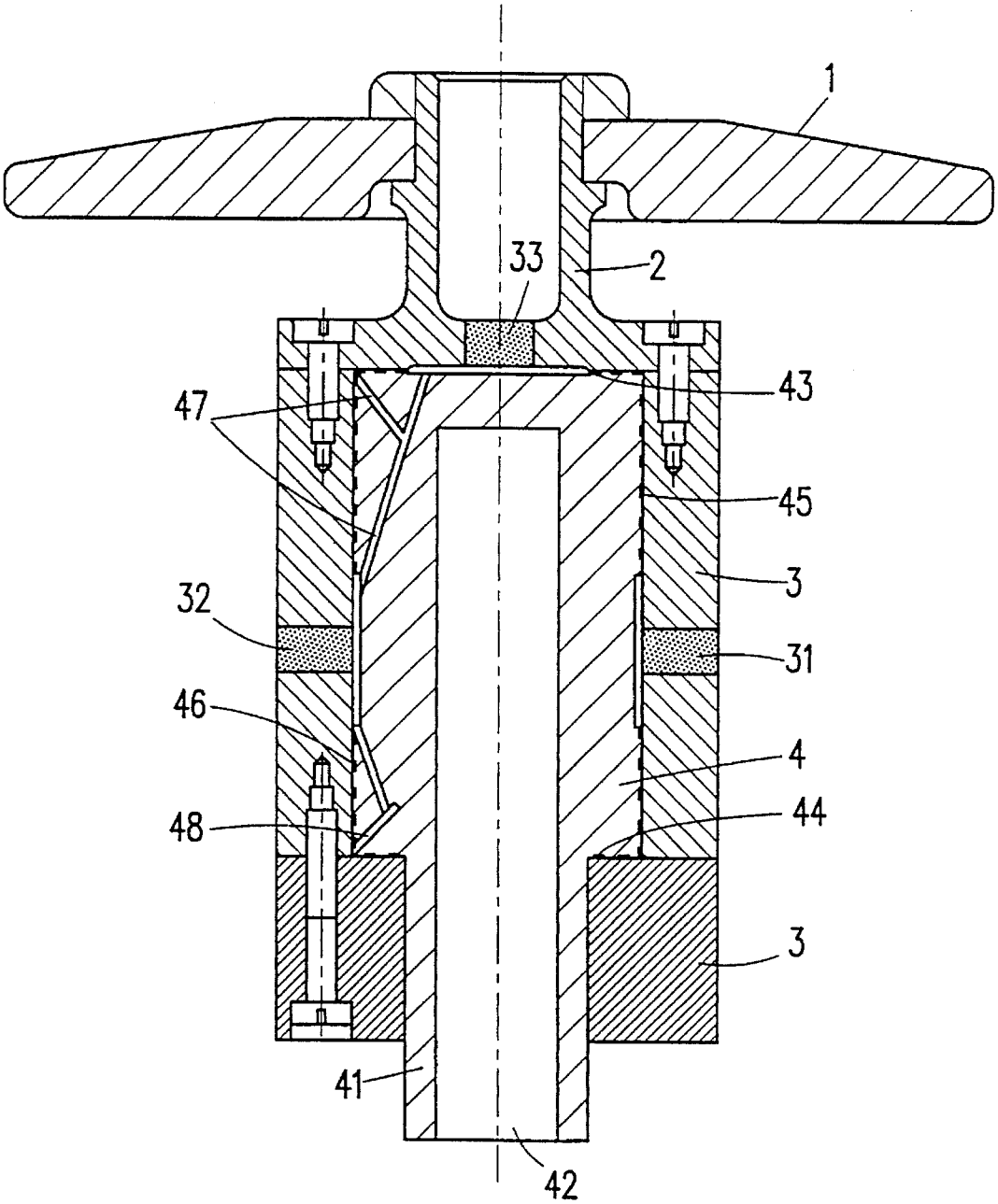
1
33
2
43
47
45
3
32
31
46
4
48
44
3
41
42

ROTARY-ANODE X-RAY TUBE COMPRISING A SLEEVE BEARING

BACKGROUND OF THE INVENTION

1. Field of the Invention

The invention relates to a rotary-anode X-ray tube comprising a slave bearing with a stationary bearing potion and a rotatable bearing portion, one of the facing surfaces of which is provided with a groove pattern, between the two bearing portions there being formed a bearing gap which is filled with a lubricant at least at the area of the groove pattern.

2. Description of the Related Art

In rotary-anode X-ray tubes of this kind a problem is encountered in that gas inclusions may be present in the lubricant, said gas inclusions being formed partly in the course of operation at high temperatures. The gas inclusions collect mainly at the area of low pressure, i.e. at the edges of the groove pattern. At that area they may join and displace the lubricant, thus affecting the operation of the sleeve bearing. Such gas inclusions become manifest up until the end of the evacuation process of the X-ray tube.

In order to eliminate such gas inclusions, in the X-ray tube which is known from EP-OS 552 808 a duct system is provided in the center of its bearing portion, which system is filled only partly with lubricant; the reminder of the duct system can accommodate the gas inclusions. In that case there is a risk of escape of lubricant from the duct system.

Furthermore, from EP-OS 479 198 a rotary-anode X-ray tube of the kind set forth is known in which the bearing gap continues outwards into a labyrinth in order to prevent the escape of lubricant. The labyrinth opens into a chamber which is sealed from the environment by a porous substance of a material which reacts with the lubricant. This porous substance can be traversed by gas inclusions whereas the lubricant is retained in the substance. When gas inclusions can reach the substance through the labyrinth, however, they can no longer affect the operation of the slave bearing any way. The effect on the gas inclusions at the area of the sleeve bearing, therefore, is limits. If the porous substance were used in the vicinity of the groove pattern, there would be a risk of not only the gas inclusions but also the lubricant reaching the porous substance in which it is retained and hence withdrawn from the sleeve bearing.

SUMMARY OF THE INVENTION

It is an object of the present invention to construct a rotary-anode X-ray tube of the kind set forth in such a manner that gaseous inclusions in the lubricant which influence the operation of the sleeve bearing can be discharged. This object is achieved in accordance with the invention in that in at least one of the two bearing portions a filter member which cannot be wetted by lubricant is provided in an area outside the groove pattern, the bearing gap communicating with the vacuum space of the X-ray tube via said filter member.

A "filter member" is to be understood to mean herein a member which comprises openings wherethrough the gas inclusions in the vacuum space of the X-ray tube can emerge. Because the filter member contains a material which cannot be wetted by the lubricant, the surface tension of the lubricant prevents it from flowing through the filter member so as to emerge on the side which is remote from the beating gap.

The filter member may consist of a material which cannot be wetted by the lubricant for example ceramic or glass when a gallium alloy is used as the lubricant. However, it may also consist of a basic material which itself can be wetted by the lubricant but which has been provided with a coating which cannot be wetted by the lubricant. This coating should then also cover the surface inside the filter member.

The filter member itself may have different shapes. In a further embodiment of the invention, it can be formed by a member provided with bores; in another embodiment, an open-pore sintered member can be used, and in another embodiment yet the filter member can be formed by a net or a gauze. Perforated foils are also feasible.

Because of its surface tension, the lubricant is repelled in the form of beads by a non-wettable surface. In given circumstances, therefore, problems may arise when the bearing is filled with the lubricant. These problems are avoided when the surface of the filter member facing the bearing gap is conceived so that it can be wetted by the lubricant. Thus, only the surface of the filter member which faces the beating gap can then be wetted by the lubricant, so that repulsion in the form of beads is avoided. The lubricant still cannot penetrate the filter member because the latter can be wetted by the lubricant, except for its surface facing the bearing gap. This embodiment of the invention can be implemented by coating the surface facing the bearing gap in the case of a filter member which consists of a material which cannot be wetted by a wettable coating or by grinding off the coating from the surface facing the bearing gap in the case of a filter member which consists of a material which can be wetted by the lubricant and is provided with a non-wettable coating.

When two groove patterns, for example for axial and radial journalling, adjoin one another, it is not simply possible to arrange a filter member at that area. The gas inclusions occurring at that area, however, can be discharged in that at least one edge of one groove pattern communicates with the filter member via a capillary system.

In a further embodiment of the invention, two groove patterns for taking up radial bearing forces are provided at a distance from one another, the filter member being arranged between said groove patterns. Gas inclusions occurring at the facing edges of the groove patterns can thus be discharged.

In another embodiment of the invention, one groove pattern is provided for taking up axial bearing forces and a filter member is arranged in the centre enclosed by said groove pattern. A groove pattern for taking up axial bearing forces forms a circular ring which encloses the gas inclusions occurring in the centre thereof. These gas inclusions are discharged by the filter member.

BRIEF DESCRIPTION OF THE DRAWING

The invention will be described in detail hereinafter with reference to the drawing, the sole figure of which shows a cross-sectional view of the rotary anode of a rotary-anode X-ray tube, the other parts of which are not shown.

DETAILED DESCRIPTION OF THE PREFERRED

Referring to the sole figure of the drawing, the rotary anode comprises an anode disc 1 which is connected, via a stem 2, to an outer, rotatable bearing portion 3 which encloses an inner, stationary bearing portion 4.

The inner bearing portion 4 of the present embodiment is shaped as a cylinder which changes over downwards into a shaft 41 of smaller diameter which projects from the bearing portion 3. The outer circumference of the shaft 41 is connected to the envelope (not shown) of the X-ray tube in a vacuum tight manner, so that the portions 1 . . . 4 are accommodated in the vacuum space of the X-ray tube. Merely the central bore 42 within the bearing portion 4, provided for cooling purposes, is situated outside the vacuum space. Therefore, a liquid cooling medium can be introduced therein.

On both oppositely situated end faces of the cylinder 4 there is provided a helical groove pattern 43, 44, respectively. Moreover, on the outer circumference of the stationary bearing portion 3 there are provided two helical groove patterns 45 and 46. The inner contour of the outer bearing portion 3 matches the outer contour of the inner beating portion 4 in such a manner that narrow bearing gaps (of from 10 to 50 μm) are formed at least at the area of the helical groove patterns 43 . . . 46, a liquid lubricant consisting of gallium or a gallium alloy being present in said gap during operation.

During operation of the X-ray tube, gas inclusions may occur in the lubricant, notably when higher temperatures are reached, which gas inclusions collect mainly at the areas of low pressure, i.e. at the edges of the helical groove patterns 43 . . . 46. The gas inclusions occurring at the inner edge of the helical groove pattern 44 can reach the interior of the X-ray tube along the shaft 41. Gas inclusions at the other edges of the helical groove bearings 43 to 46, however could reach this interior only through the bearing gaps; this is not readily possible on account of the comparatively high surface tension of the lubricant. Therefore, at the area between the two groove patterns 45 and 46, taking up the radial bearing forces, sintered members 31 and 32 are mounted so as to be offset relative to one another on the circumference. Gas inclusions at the facing edges of the groove patterns 45 and 46 can reach the vacuum space of the X-ray tube via these filter members. A further filter member 33 is arranged so as to be concentric with the axis of rotation of the rotary anode at the centre of the groove pattern 43 provided on the upper end face. Gas inclusions at the inner edge of the groove pattern can thus be discharged.

The filter members 31, 32 and 33 cannot be wetted by the lubricant. To this end, they may be made of a material which itself cannot be wetted by the lubricant, for example a ceramic material, or they may be made of a material which itself can be wetted by the lubricant (for example, molybdenum) but is covered by a layer consisting of a non-wettable material (for example, titanium dioxide).

The filter members are provided with openings wherethrough the gas inclusions can pass but which are not so large that lubricant could pass therethrough without obstruction. A filter member may be formed by a member provided with bores, by one-layer or multi-layer nets or perforated foils, by an open-pore sintered member or by a gauze. The pore diameter in the open-pore sintered body 33, serving as a filter member which is not exposed to a high lubricant pressure resulting from centrifugal forces, can be in the range of from 10 to 14 μm (preferably <12 μm). The pore diameter in the sintered members 31, 32 should be smaller, i.e. smaller as the centrifugal accelerations occurring at that area during operation are higher.

For structural reasons it is not readily possible to arrange filter members at the areas where the groove patterns 43 and 45 as well as the groove patterns 44 and 46 adjoin one another. Therefore, the gas inclusions occurring at the outer edge of the groove pattern 43 or at the upper edge of the groove pattern 45 communicate, via a capillary system 47, with the areas on the surface of the bearing portion 4 wherefrom gas inclusions can be discharged via the filter members 31 . . . 33. The diameter of the capillaries should be substantially greater than the width of the bearing gap at the area of the groove pattern, for example 100 μm or more, but not so large that its capillary effect can no longer hold the lubricant. This may give rise to comparatively long and thin lubricant ducts which may have the construction described in German Patent application P 43 39 817.

Analogously, the area between the groove patterns 44 and 46 is connected to the active area of the filter members 31 and 32 via a capillary system 48.

When the lubricant comes into contact with a surface which cannot be wetted thereby, in extreme cases it contracts so as to form lubricant beads. If such lubricant beads were formed at the area of the filter members, problems could arise during the filling of the bearing with the lubricant. These problems can be avoided by making exclusively the filter body surface which faces the beating gap wettable. In the case of a filter body consisting of a material which cannot be wetted by the lubricant this could be achieved by deposition of a suitable coating (for example, titanium dioxide). However, in the case of a filter member consisting of a wettable material (molybdenum) and provided with a non-wettable coating, inclusive of the surfaces inside the filter member, this could be achieved by grinding off the coating from the side facing the bearing gap.

The invention has been described on the basis of a sleeve beating comprising a stationary inner bearing portion 4 and a rotatable outer beating portion 3. However, the invention can also be used for a sleeve bearing in which the outer beating portion is stationary and the inner bearing portion is rotatable. The capillary system should then again be provided in the stationary bearing portion. In that case the filter members must be provided in the wall of the outer bearing portion.

I claim:

1. A rotary-anode X-ray tube comprising portions with a vacuum space, portions outside a vacuum space and a sleeve bearing therebetween, said sleeve bearing having a stationary bearing portion and a rotatable bearing portion, one of the facing surfaces of which is provided with a groove pattern, between the two bearing portions there being formed a bearing gap which is filled with a lubricant at least at the area of the groove pattern, characterized in that a filter member which cannot be wetted by the lubricant extends from the bearing gap through one of the two bearing portions to the vacuum space, said filter member being provided in an area outside the groove pattern, the bearing gap communicating with the vacuum space of the X-ray tube directly through said filter member via a plurality of passageways extending through said filter member, said passageways having a size too small for passage of said lubricant therethrough but sufficiently large in size to allow passage of gas therethrough.

2. A rotary-anode X-ray tube as claimed in claim 1, characterized in that the filter member is formed by a member provided with bores.

3. A rotary-anode X-ray tube comprising portions with a vacuum space, portions outside a vacuum space and a sleeve bearing therebetween, said sleeve bearing having a stationary bearing portion and a rotatable bearing portion, one of the facing surfaces of which is provided with a groove pattern, between the two bearing portions there being formed a bearing gap which is filled with a lubricant at least at the area of the groove pattern, characterized in that in at least one of the two bearing portions a filter member which cannot be wetted by the lubricant is provided in an area outside the groove pattern, the bearing gap communicating with the vacuum space of the X-ray tube via said filter member and in that an open-pore sintered member is used as the filter member.

4. A rotary-anode X-ray tube comprising portions with a vacuum space, portions outside a vacuum space and a sleeve bearing therebetween, said sleeve bearing having a stationary bearing portion and a rotatable bearing portion, one of the facing surfaces of which is provided with a groove pattern, between the two bearing portions there being formed a bearing gap which is filled with a lubricant at least at the area of the groove pattern, characterized in that in at least one of the two bearing portions a filter member which cannot be wetted by the lubricant is provided in an area outside the groove pattern, the bearing gap communicating with the vacuum space of the X-ray tube via said filter member and in that the filter member is formed by a net or a gauze.

5. A rotary-anode X-ray tube as claimed in claim 1, characterized in that the surface of the filter member facing the bearing gap is conceived so that it can be wetted by the lubricant.

6. An X-ray tube comprising portions with a vacuum space, portions outside a vacuum space and a sleeve bearing therebetween, said sleeve bearing having a stationary bearing portion and a rotatable bearing portion, one of the facing surfaces of which is provided with a groove pattern, between the two bearing portions there being formed a bearing gap which is filled with a lubricant at least at the area of the groove pattern, characterized in that in at least one of the two bearing portions a filter member which cannot be wetted by the lubricant is provided in an area outside the groove pattern, the bearing gap communicating with the vacuum space of the X-ray tube via said filter member and in that at least one edge of one groove pattern communicates with the filter member via a capillary system.

7. A rotary-anode X-ray tube comprising portions with a vacuum space, portions outside a vacuum space and a sleeve bearing therebetween, said sleeve bearing having a stationary bearing portion and a rotatable bearing portion, one of the facing surfaces of which is provided with a groove pattern, between the two bearing portions there being formed a bearing gap which is filled with a lubricant at least at the area of the groove pattern, characterized in that in at least one of the two bearing portions a filter member which cannot be wetted by the lubricant is provided in an area outside the groove pattern, the bearing gap communicating with the vacuum space of the X-ray tube via said filter member and in that two groove patterns for taking up radial bearing forces are provided at a distance from one another, the filter member being arranged between said groove patterns.

8. A rotary-anode X-ray tube comprising portions with a vacuum space, portions outside a vacuum space and a sleeve bearing therebetween, said sleeve bearing having a stationary bearing portion and a rotatable bearing portion, one of the facing surfaces of which is provided with a groove pattern, between the two bearing portions there being formed a bearing gap which is filled with a lubricant at least at the area of the groove pattern, characterized in that in at least one of the two bearing portions a filter member which cannot be wetted by the lubricant is provided in an area outside the groove pattern, the bearing gap communicating with the vacuum space of the X-ray tube via said filter member and in that one groove pattern is provided for taking up axial bearing forces, said filter member being arranged in the center enclosed by said groove pattern.

9. A rotary-anode X-ray tube comprising portions with a vacuum space, portions outside a vacuum space and a sleeve bearing therebetween, said sleeve bearing having a stationary bearing portion and a rotatable bearing portion, one of the facing surfaces of which is provided with a groove pattern, between the two bearing portions there being formed a bearing gap which is filled with a lubricant at least at the area of the groove pattern, characterized in that in at least one of the two bearing portions a filter member which cannot be wetted by the lubricant is provided in an area outside the groove pattern, the bearing gap communicating with the vacuum space of the X-ray tube via said filter member and in that the filter member is formed by a member provided with bores and in that the surface of the filter member facing the bearing gap is conceived so that it can be wetted by the lubricant.

10. A rotary-anode X-ray tube as claimed in claim 3, characterized in that the surface of the filter member facing the bearing gap is conceived so that it can be wetted by the lubricant.

11. A rotary-anode X-ray tube as claimed in claim 4, characterized in that the surface of the filter member facing the bearing gap is conceived so that it can be wetted by the lubricant.

* * * * *